US008180263B2

(12) United States Patent
Kukuchi

(10) Patent No.: US 8,180,263 B2
(45) Date of Patent: May 15, 2012

(54) DEVELOPING APPARATUS AND IMAGE FORMING APPARATUS THAT INCORPORATES THE DEVELOPING APPARATUS

(75) Inventor: Kenji Kukuchi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 1067 days.

(21) Appl. No.: 11/964,265

(22) Filed: Dec. 26, 2007

(65) Prior Publication Data

US 2008/0159790 A1 Jul. 3, 2008

(30) Foreign Application Priority Data

Dec. 28, 2006 (JP) ..... 2006-354556

(51) Int. Cl.
*G03G 15/08* (2006.01)

(52) U.S. Cl. ..... 399/281

(58) Field of Classification Search ..... 399/281
See application file for complete search history.

(56) References Cited

U.S. PATENT DOCUMENTS

| | | | | |
|---|---|---|---|---|
| 6,801,740 | B2 * | 10/2004 | Ito et al. | 399/284 |
| 2003/0118374 | A1 * | 6/2003 | Eun et al. | 399/252 |
| 2003/0219276 | A1 * | 11/2003 | Sato et al. | 399/103 |
| 2007/0189812 | A1 * | 8/2007 | Murayama et al. | 399/258 |

FOREIGN PATENT DOCUMENTS

| | | | |
|---|---|---|---|
| JP | 08006385 | A | 1/1996 |
| JP | 08114980 | A | 5/1996 |
| JP | 10213961 | A | 8/1998 |
| JP | 11316496 | A | 11/1999 |
| JP | 2001201927 | A | 7/2001 |
| JP | 2002-31952 | A | 1/2002 |
| JP | 2005308907 | A | 11/2005 |
| JP | 2006259013 | A | 9/2006 |

OTHER PUBLICATIONS

Office Action issued Mar. 10, 2009 in Japanese Patent Application No. 2006-354556.

* cited by examiner

*Primary Examiner* — David Gray
*Assistant Examiner* — Andrew Do
(74) *Attorney, Agent, or Firm* — Panitch Schwarze Belisario & Nadel LLP

(57) ABSTRACT

A developing apparatus is incorporated in an image forming apparatus. An electrostatic latent image is formed on an image bearing body. A developing member supplies a developer material to the electrostatic latent image. A supplying member supplies the developer material to the developing member. A developer material chamber holds the developer material therein. A layer forming member is provide in the proximity to the supplying member, and forms a layer of the developer material. The layer forming member is positioned such that a gap Δg is defined between the layer forming member and the supplying member. When the supplying member rotates, the surface of the layer forming member applies pressure to the toner on the supplying member to form the layer having a smooth surface not more than 0.5 mm.

20 Claims, 9 Drawing Sheets

PRIOR ART

DEVELOPING APPARATUS AND IMAGE FORMING APPARATUS THAT INCORPORATES THE DEVELOPING APPARATUS

BACKGROUND OF THE INVENTION

1. Field of the Invention

The present invention relates to a developing apparatus that supplies a developer material to a developing member and an image forming apparatus that incorporates the developing apparatus.

2. Description of the Related Art

Electrophotographic image forming apparatuses including printers, copying machines, and facsimile machines use electrophotographic technology. An exposing unit illuminates the uniformly charged surface of a photoconductive drum to form an electrostatic latent image. The electrostatic latent image is developed with toner into a toner image. The toner image is then transferred onto print paper. Subsequently, the toner image on the paper is fixed into a permanent image.

If the toner in the developing apparatus has been deteriorated, a sufficient amount of the toner may not be supplied to a toner supplying roller and a developing roller reliably. Deteriorated toner causes uneven toner density in developed images or causing light or vague images to be printed. JP2002-31952A discloses a developing apparatus in which a toner supply controlling member causes toner to fall onto a contact area where a toner supplying roller and a developing roller are in contact with each other.

However, if a gap between the toner supplying roller and the developing roller is relatively large, the toner is subjected to convection in the gap so that the toner is difficult to adhere to the toner supplying roller or the toner adhering to the toner supplying roller may come off.

SUMMARY OF THE INVENTION

The present invention was made in view of the above-mentioned problems.

An object of the invention is to provide a developing apparatus in which even if toner deteriorates due to convention in a large gap between a toner supplying roller and a developing roller, the toner adheres to the toner supplying roller without difficulty.

A developing apparatus is incorporated in an image forming apparatus. An electrostatic latent image is formed on an image bearing body. A developing member supplies a developer material to the electrostatic latent image. A supplying member supplies the developer material to the developing member. A developer material chamber holds the developer material therein. A layer forming member is provide in the proximity to the supplying member, and forms a layer of the developer material.

The layer forming member includes a first guide surface and a second guide surface. The layer forming member is positioned such that a gap (Δg) is defined between the first guide surface and the supplying member. When the supplying member rotates, the first guide surface applies pressure to the toner on the supplying member to form a developer layer having a smooth surface the pressure. The layer forming member is positioned such that the second guide surface guides the developer material into the gap when the supplying member rotates.

The supplying member includes a generally cylindrical outer surface. The developer material chamber includes an inner wall surface that extends along a part of the generally cylindrical surface of the supplying member, the inner wall surface defining a gap between the developer material chamber and the supplying member. The layer forming member is positioned at a downstream end of the gap with respect to rotation of the supplying member.

The layer forming member is formed in one piece with the developer material chamber.

The layer forming member is bonded to an inner wall surface of the developer material chamber.

The layer forming member is supported by a supporting member that supports the supplying member.

The supplying member includes a diameter larger nearer a longitudinally middle portion of the supplying member. The layer forming member extends substantially parallel to the supplying member and the first guide surface extends such that the first guide surface is configured to mate with an outer contour of the supplying member while maintaining the gap (Δg).

The supplying member includes a diameter larger nearer a longitudinally middle portion of the supplying member. When layer forming member extends substantially parallel to the supplying member and the first guide surface extends such that the gap (Δg) is larger in the vicinity of longitudinal end portions of the supplying member than in a middle portion of the supplying member.

The supplying member includes a diameter larger nearer a longitudinally middle portion of the supplying member. The layer forming member is mounted to a mounting member supported on a supporting member that supports the supplying member, the mounting member being movable relative to the supporting member.

The mounting member is one of two mounting members disposed in the vicinity of longitudinal end portions of the supplying member, each one of the mounting members includes a plurality of fitting engagement portions, wherein the plurality of fitting engagement portions are provided such that center-to-center distances between the plurality of fitting engagement portions and the supplying member are different from one another.

The gap (Δg) is not more than 0.5 mm.

The developing apparatus is incorporated in an image forming apparatus. The image forming apparatus includes an exposing unit, a transfer unit, a fixing unit, and a transport unit. The exposing unit illuminates a charged surface of the image bearing body to form an electrostatic latent image. The transfer unit transfers a visible image from the image bearing body onto a print medium. The fixing unit fixes the visible image on the print medium. The transport unit transports the print medium.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Figure 1:
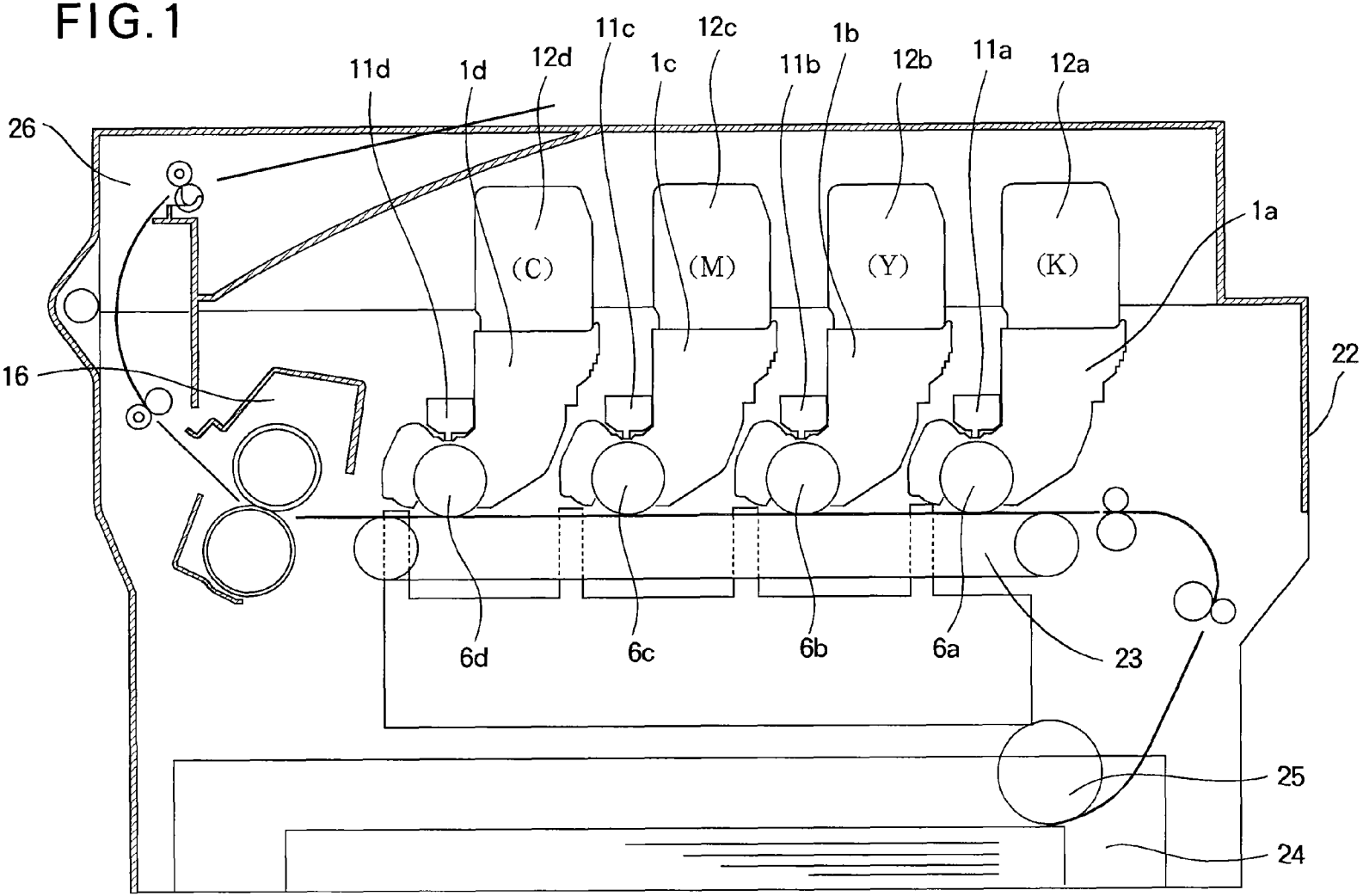
FIG. 1 illustrates the general configuration of an image forming apparatus of a first embodiment.

FIG. 1 illustrates the general configuration of an image forming apparatus 22 of a first embodiment. Developing apparatuses 1*a*-1*d* are detachably attached to the image forming apparatus 22, and form cyan magenta, yellow, and black images, respectively. Toner cartridges 12*a*-12*d* are detachably attached to the developing apparatus 1*a*-1*d*, respectively. Exposing units 11*a*-11*d* illuminate the charged surfaces of photoconductive drums 6*a*-6*d* in accordance with image data to form electrostatic latent images of corresponding colors. The electrostatic latent images formed by the exposing units 11*a*-11*d* are developed with toners of corresponding colors into toner images. A transfer belt unit 23 transports print medium 14 such as paper thereon, and transfers the toner images onto the print medium 14. A fixing unit 16 fixes the toner images of the respective colors into a permanent full color image. A paper cassette 24 holds a stack of print medium therein. A medium feeding section 25 feeds the print medium 14 to a transport path on a page-by-page basis. When the developing apparatuses 1*a*-1*d* are attached into or detached from the image forming apparatus 22, a lid 26 is opened and closed.

{General Configuration of Developing Apparatus}

Figure 2:
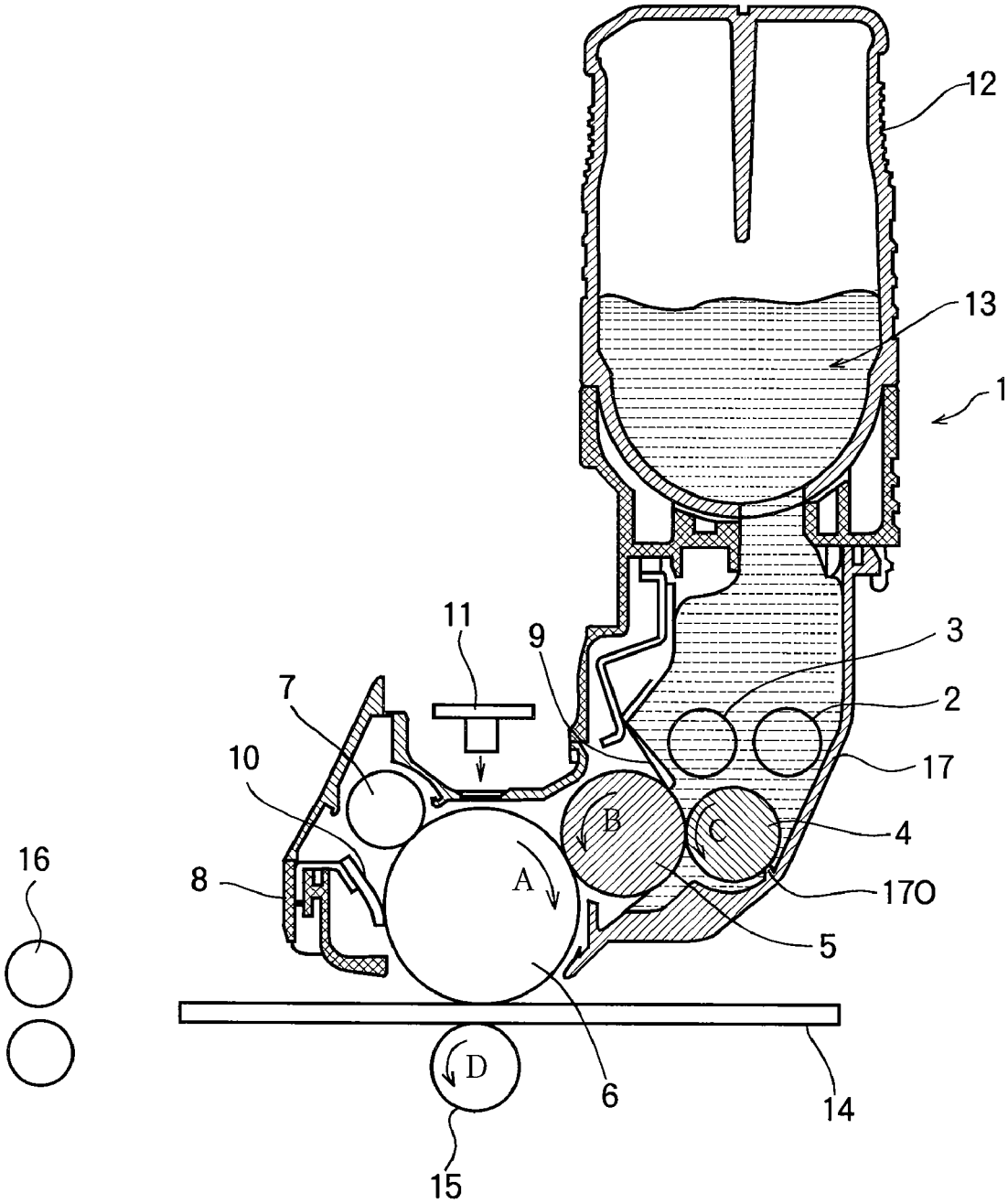
FIG. 2 illustrates one of developing apparatuses of FIG. 1.

FIG. 2 illustrates one of the developing apparatuses 1*a*-1*d* of FIG. 1. The developing apparatus includes agitators 2 and 3, a toner supplying roller 4, a developing roller 5, a photoconductive drum 6, a charging roller 7, a cleaning device 8, a developing blade 9, and a toner reservoir 17. The cleaning device 8 includes a cleaning blade 10.

The charging roller 7, an exposing unit 11, a transfer roller 15, and the cleaning blade 10 are disposed around the photoconductive drum 6. A fixing unit 16 is disposed downstream of a transport path of the print medium 14. The developing roller 5 rotates in contact with the photoconductive drum 6 to supply toner 13 to the photoconductive drum 6. The developing blade 9 is in pressure contact with the developing roller 5 to form a thin layer of toner 13 having a predetermined thickness. The toner supplying roller 4 rotates in contact with the developing roller 5 to supply the toner 13 to the developing roller 5. The toner reservoir 17 holds the toner 13 supplied from the toner cartridge 12.

The agitators 2 and 3 are rotatablly mounted in the toner reservoir 17. The toner agitators 2 and 3 agitate the toner 13 in the toner reservoir 17, thereby preventing the toner 13 from agglomerating as well as foreign material in the toner 13 from being confined in the vicinity of the developing roller 5 and the toner supplying roller 4.

The photoconductive drum 6 rotates in a direction shown by arrow A. The charging roller 7 rotates in contact with the photoconductive drum 6 and charges the entire circumferential surface of the photoconductive drum 6 uniformly. The exposing unit 11 illuminates the charged surface of the photoconductive drum 6 in accordance with image data to form an electrostatic latent image.

The agitators 2 and 3 agitate the toner 13. The toner supplying roller 4 rotates in contact with the developing roller 5 in a direction shown by arrow C, thereby supplying the toner 13 to the developing roller 5. The toner supplying roller 4 is formed of a foamed material such as silicone rubber or urethane rubber, and includes a plurality of cells (recesses) formed in its circumferential surface to hold toner therein.

The developing roller 5 rotates in contact with the photoconductive drum 6 in a direction shown by arrow B, so that the toner 13 is supplied to the photoconductive drum 6 to develop the electrostatic latent image into a toner image. The developing blade 9 is in contact with the developing roller 5 to form a thin layer of toner having a predetermined thickness, thereby ensuring that a predetermined amount of toner 13 is supplied to the photoconductive drum 6.

The transfer roller 15 extends in parallel to the photoconductive drum 6 to form a transfer point between the photoconductive drum 6 and transfer roller 15, and rotates in a direction shown by arrow D so that the toner image is transferred from the photoconductive drum 6 onto the print medium 14.

After the toner image has been transferred onto the print medium 14, the cleaning blade 10 scrapes the residual toner off the photoconductive drum 6.

Figure 3:
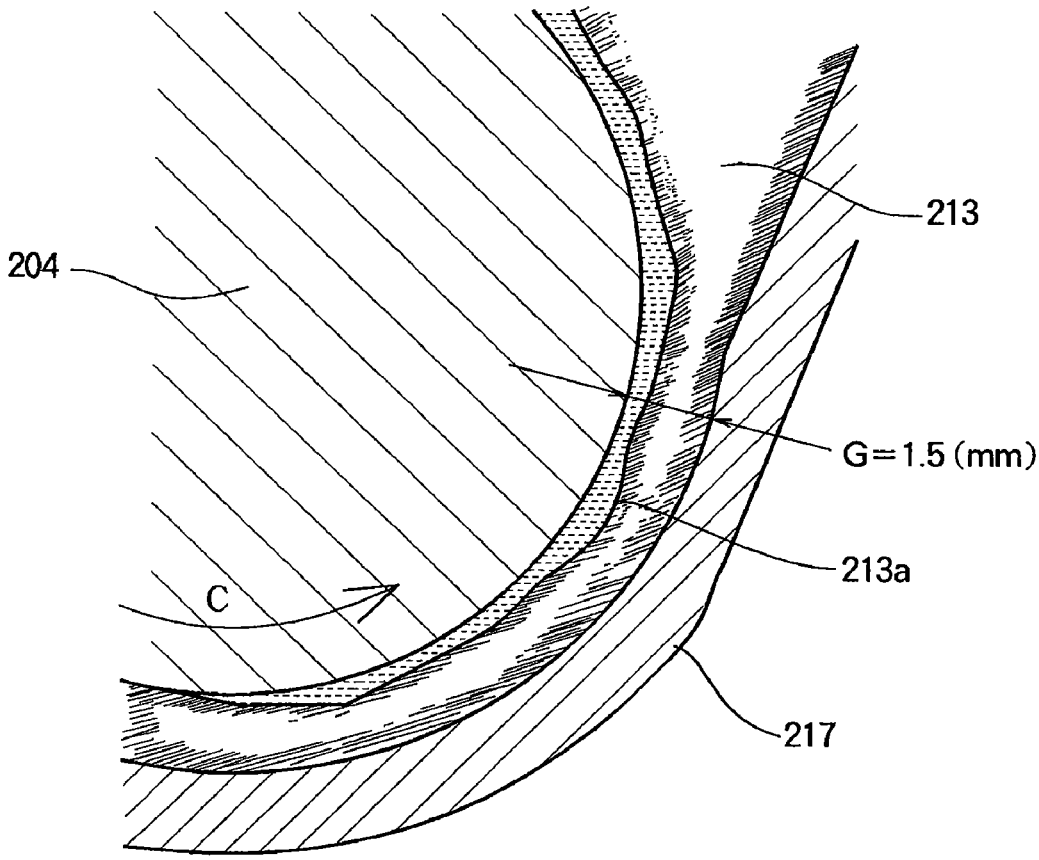
FIG. 3 is an expanded view illustrating the relation between a toner supplying roller and a developing roller of a conventional developing apparatus.

FIG. 3 is an expanded view illustrating the relation between a toner supplying roller and a developing roller of a conventional developing apparatus. Referring to FIG. 3, a bottom portion of the inner bottom wall of the toner reservoir 217 extends around the toner supplying roller 204 such that a gap G is defined between the toner supplying roller 204 and the inner bottom wall. Specifically, the gap G is approximately 1.5 mm. A toner layer 213*a* is a layer of toner 213 having an uneven thickness since the toner 213 merely adheres to the surface of the toner supplying roller 204 by the Coulomb force. If the gap G is much greater than 1.5 mm, the amount of toner adheres to the toner supplying roller 204 becomes more uneven, and the toner layer 213*a* having a more uneven thickness is brought into contact with the developing roller 205.

Figure 4:
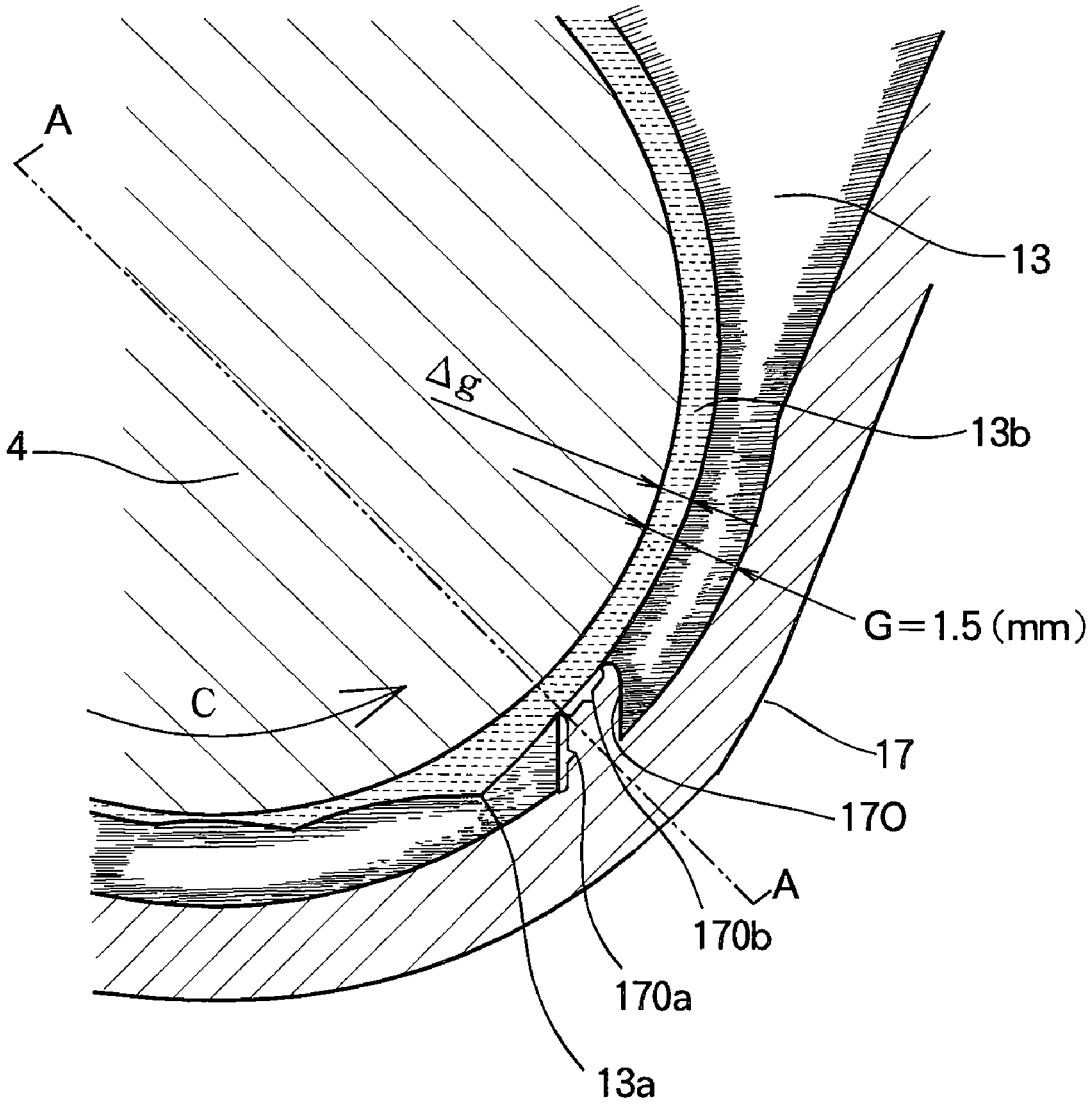
FIG. 4 is an expanded view illustrating the relationship between a toner supplying roller and a toner of the developing apparatus shown in FIG. 2.
Figure 5:
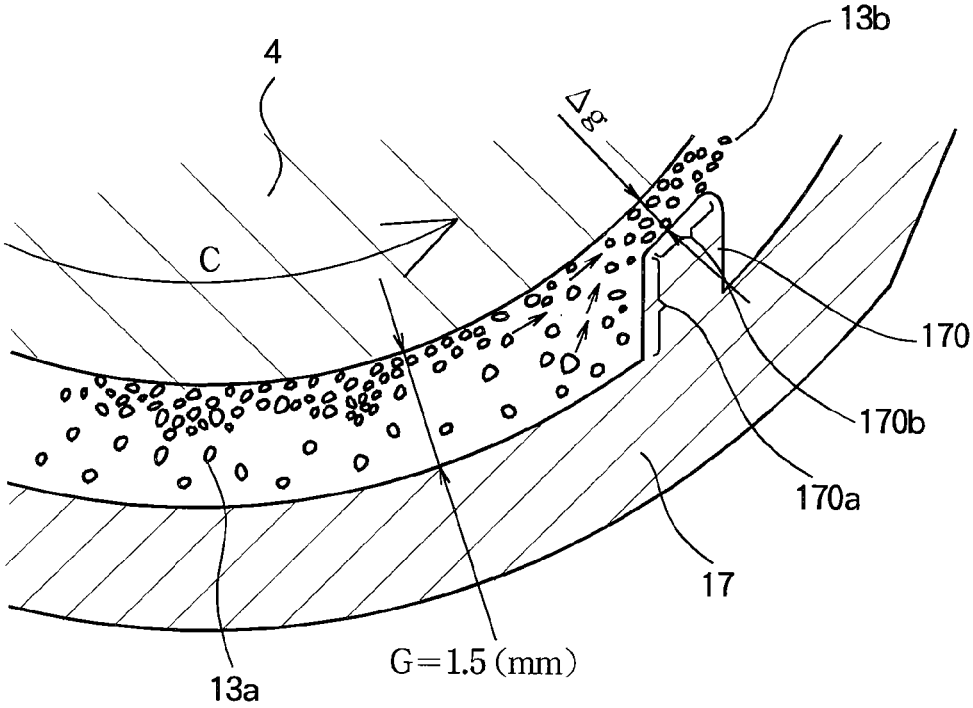
FIG. 5 is an expanded cross sectional view of FIG. 4, illustrating how the uneven thickness of a toner layer is formed into a predetermined thickness.

FIG. 4 is an expanded view illustrating the relationship between the toner supplying roller 4 and the toner 13 in the developing apparatus 1 shown in FIG. 2. FIG. 5 is an expanded cross sectional view of FIG. 4, illustrating how the uneven thickness of a toner layer is formed into a predetermined thickness. Referring to FIGS. 4 and 5, a rib 170 is formed on the bottom surface of the toner reservoir 17. The rib 170 is positioned in the vicinity of a downstream end portion of a narrow space between the toner supplying roller 4 and the rib 170, and extends parallel to the toner supplying roller 4 with the gap G formed between the toner supplying roller 4 and the rib 170. The rib 170 includes a guide surface 170*a* and a guide surface 170*b*. The guide surface 170*b* extends in a longitudinal direction the circumferential surface of the toner supplying roller 4, defining a gap Δg between the toner supplying roller 4 and the rib 170. The guide surface 170*a* guides the toner to move toward the gap Δg. As the toner passes through the gap Δg, the toner on the toner supplying roller 4 is formed into a layer having a uniform thickness of not more than 0.5 mm defined by the gap Δg.

The toner layer 13*a* is a layer formed on the toner supplying roller 4 upstream of the rib 170, and the toner layer 13*b* is a layer formed on the toner supplying roller 4 downstream of the rib 170. The toner layers 13*a* and 13*b* are both electrostatically formed of the toner 13 charged in the toner reservoir 17. The toner layer 13*a* has an uneven thickness while the toner layer 13*b* has a predetermined thickness and a smooth surface.

Table 1 lists resultant levels of vague image for different values of the gap Δg when an image having a duty of 100% was printed.

TABLE 1

| Δg (mm) | Vague Image |
|---|---|
| 1.5 | larger than 5% |
| 1.0 | larger than 5% |
| 0.8 | larger than 5% |
| 0.7 | less than 5% |
| 0.5 | NO |
| 0 | NO |
| −0.2 | less than 5% |

The results in Table 1 reveals that the level of vague image is less than 5% for Δg from 0.7 mm to −0.2 mm for normal images (e.g., characters). If the image forming apparatus is designed to print images other than photographic images, the gap Δg may be selected in the range of 0.7 to −0.2 mm. A negative gap Δg=−0.2 mm means that the rib 170 is pressed into the toner supplying roller 4 by 0.2 mm.

The results in Table 1 reveals that no vague image occurs for Δg in the range of 0.5 mm to 0 mm. This implies that gaps in the range of 0.5 mm to 0 mm allow stable supply of toner 13 to the developing roller 5, and that a stable print quality may be obtained for a wide range of image forming apparatuses including those designed print photographic images.

Figure 6:
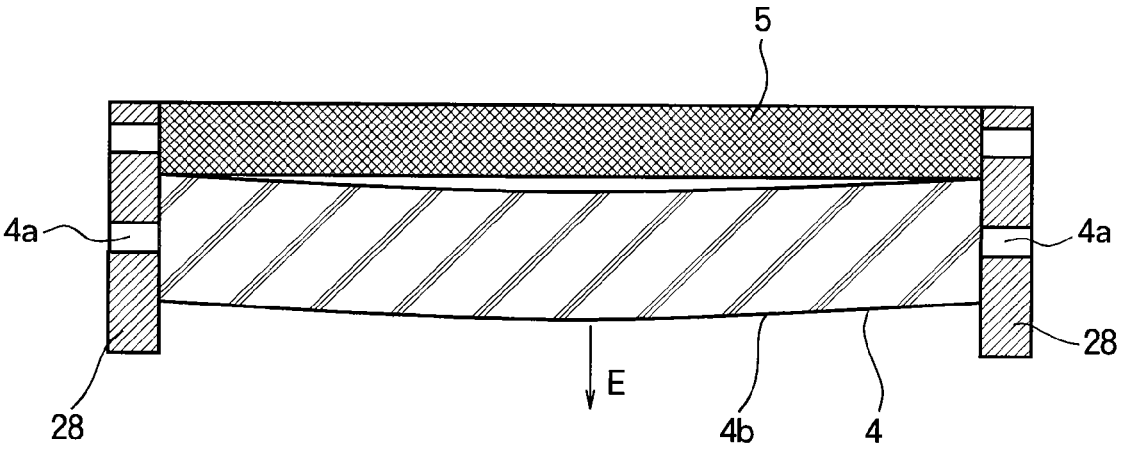
FIG. 6 illustrates the relation between the developing roller and the toner supplying roller covered with a resilient foamed body.

FIG. 6 illustrates the relation between the developing roller 5 and the toner supplying roller 4 covered with a resilient foamed body 4*b* in the shape of a cylinder. The shaft 4*a* of the toner supplying roller 4 is rotatably supported by side plates 28 such that a nip is formed between the foamed body 4*b* and the developing roller 5 across the length of the developing roller 5.

If the shaft 4*a* and the side plates 28 are rigid enough, the shaft 4*a* will not flex, and therefore the nip may be uniform across the full length of the developing roller 5. Thus, in order for the shaft 4*a* and the side plates 28 to be rigid enough, the shaft 4*a* and the side plates 28 tend to be large in size, which is detrimental to implementation of a small size, light weight apparatus. For this reason, the shaft 4*a* is designed to slightly flex in a direction shown by arrow E. Because the longitudinal end portions of the shaft 4*a* are supported at a predetermined distance from the shaft of the developing roller 5, the flexure of the shaft 4*a* causes a sufficient nip at longitudinal end portions of the developing roller 5 and toner supplying roller 4 but an insufficient nip in the middle portion.

The toner supplying roller 4 of the embodiment has a shape of a barrel, i.e., diameter of the toner supplying roller 4 is larger nearer the longitudinally middle portion of the toner supplying roller 4. This shape of the toner supplying roller 4 is effective in providing a uniform nip across the length of the developing roller 5.

Because the toner supplying roller 4 has the shape of a barrel, the rib 170 needs to be configured to mate with or accommodate the specific contour of the toner supplying roller 4, i.e., the height of the rib 170 is lower in the longitudinal middle portion than in the longitudinal end portions.

Figure 7:
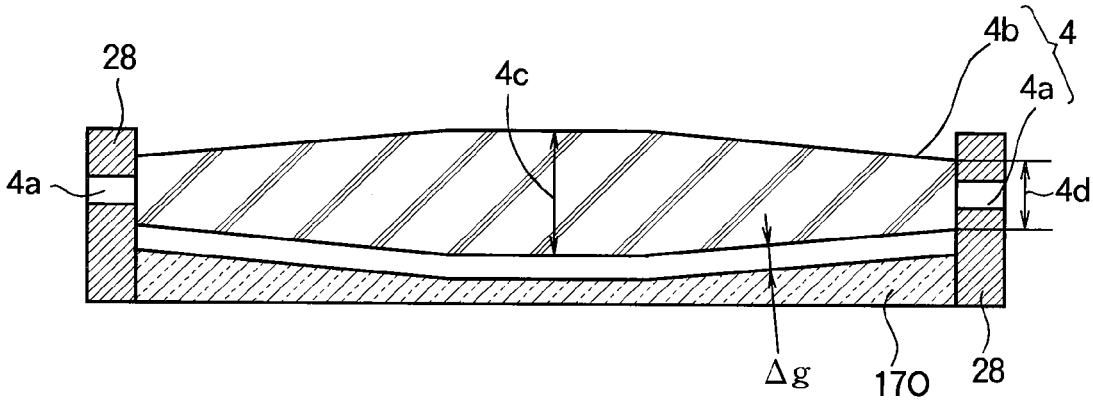
FIG. 7 is a cross-sectional view take along a line A-A of FIG. 4, illustrating the configuration and arrangement of the rib when the toner supplying roller is in the shape of a barrel.

FIG. 7 is a cross-sectional view take along a line A-A of FIG. 4, illustrating the configuration and arrangement of the rib 170 when the toner supplying roller 4 is in the shape of a barrel. Referring to FIG. 7, the toner supplying roller 4 has a larger diameter nearer the longitudinal middle portion of the toner supply roller 4. Thus, the diameter 4c at the longitudinal middle portion is larger than that 4d at the longitudinal end portions. When the toner supplying roller 4 having a barrel shape flexes, the nip formed between the toner supplying roller 4 and the developing roller 5 may be substantially uniform. The diameters 4*c* and 4*d* are selected such that 4*c*=4*d*+0.5 mm approximately. The toner supplying roller 4 is supported at its longitudinal end portions by the side plates 28.

The shape of the guide surface 170*b* is configured to mate with or accommodate the specific contour of the barrel-shaped toner supplying roller 4 such that the gap between the toner supplying roller 4 and the guide surface 170*b* is uniform across the full length of the toner supplying roller 4.

{Operation of Image Forming Apparatus}

The operation of the image forming apparatus of the aforementioned configuration will be described. The exposing unit 11 illuminates the charged surface of the photoconductive drum 6 in accordance with image data to form an electrostatic latent image. The electrostatic latent image is then developed with the toner 13 supplied from the developing roller 5 into a toner image. The toner image is transferred onto the print medium 14. The print medium 14 is transported to the fixing unit 16 where the toner image is fixed into a permanent image. This completes the printing of an image.

The toner cartridge 12 includes an opening formed at a lower portion of the toner cartridge 12. When a shutter is opened, the toner 13 is discharged through the opening into the toner reservoir 17. The agitators 2 and 3 rotate to agitate the toner 13, thereby supplying the toner 13 to the toner supplying roller 4 efficiently.

The toner supplying roller 4 rotates in the same direction as the developing roller 5 such that they rotate in contact with each other at predetermined speeds but with a certain difference in speed. The toner 13 is supplied to the developing roller 5 in accordance with the potential difference between the two rollers 4 and 5. The rotation of the toner supplying roller 4 in contact with the developing roller 5 effectively scrapes excessive toner adhering to the developing roller 5. The toner 13 in the nip between the toner supplying roller 4 and the developing roller 5 is somewhat charged triboelectrically due to the friction resulting from the difference in rotational speed.

As the developing roller 5 rotates, the toner 13 on the developing roller 5 is transported to the developing blade 6. The developing blade 6 forms a thin layer of the toner 13 having a predetermined thickness. Then, the thin layer of the toner 13 is brought into contact with the photoconductive drum 6. The toner 13 is attracted by the Coulomb force to the electrostatic latent image formed on the photoconductive drum 6, thereby forming a toner image.

The toner supplying roller 4 rotates in a direction shown by arrow C (FIGS. 4 and 5). The toner 13 confined under the toner supplying roller 4 adheres to the toner supplying roller 4 with an uneven thickness. As the toner supplying roller 4 rotates, the guide surface 170*b* presses the toner 13 against the circumferential surface of the toner supplying roller 4 to form the toner layer 13*b* with a uniform thickness across the full length of the developing roller 5. The smooth circumferential surface of the toner layer 13*b* is subjected to a relatively small friction with the toner 13 surrounding the toner layer 13*b*, preventing further deposition of the toner on or detachment of the toner from the toner supplying roller 4. This provides stable supply of the toner 13 to the developing roller 5.

As described above, the rib 170 applies pressure against the toner layer 13*a* having an uneven thickness to form a toner layer 13*b* having a predetermined thickness.

Because the gap Δg between the toner supplying roller 4 and the guide surface 170*b* is uniform across the full length of the toner supplying roller 4, the nip formed between the toner supplying roller 4 and the developing roller 5 may be uniform, so that the toner 13 may be supplied uniformly across the length of the toner supplying roller 4.

The embodiment is effective in preventing the toner layer 13*b* from having an uneven thickness across the length of the toner supplying roller 4, preventing an uneven thickness of the toner layer 13*b* due to the convection of the toner 13 within the gap Δg, and preventing an uneven thickness of the toner 13 due to deterioration of the toner 13.

Thus, the present invention prevents unevenness of developed toner image and vague images due to poor deposition of toner to the toner supplying roller 4.

Thus, the stable, smooth toner layer 13*b* may be formed on the toner supplying roller 4, so that a stable amount of the toner 13 may be supplied to the developing roller 5. This provides stable print quality.

As described above, the rib 170 is highly rigid, and includes the guide surfaces 170*a* and 170*b* very close to the surface of the toner supplying roller 4. Thus, even if the convection of the toner 13 occurs in a relatively large space between the toner supplying roller 4 and the toner reservoir 17, or the toner 13 is not charged enough due to deterioration, the toner 13 may still be deposited to the toner supplying roller 4 normally.

Second Embodiment

The rib 17 of the first embodiment is formed in one piece with the toner reservoir 17. In contrast, a rib 18 of a second embodiment is formed as a piece separate from the toner reservoir 17. The description of elements similar to those of the first embodiment is omitted.

Figure 8:
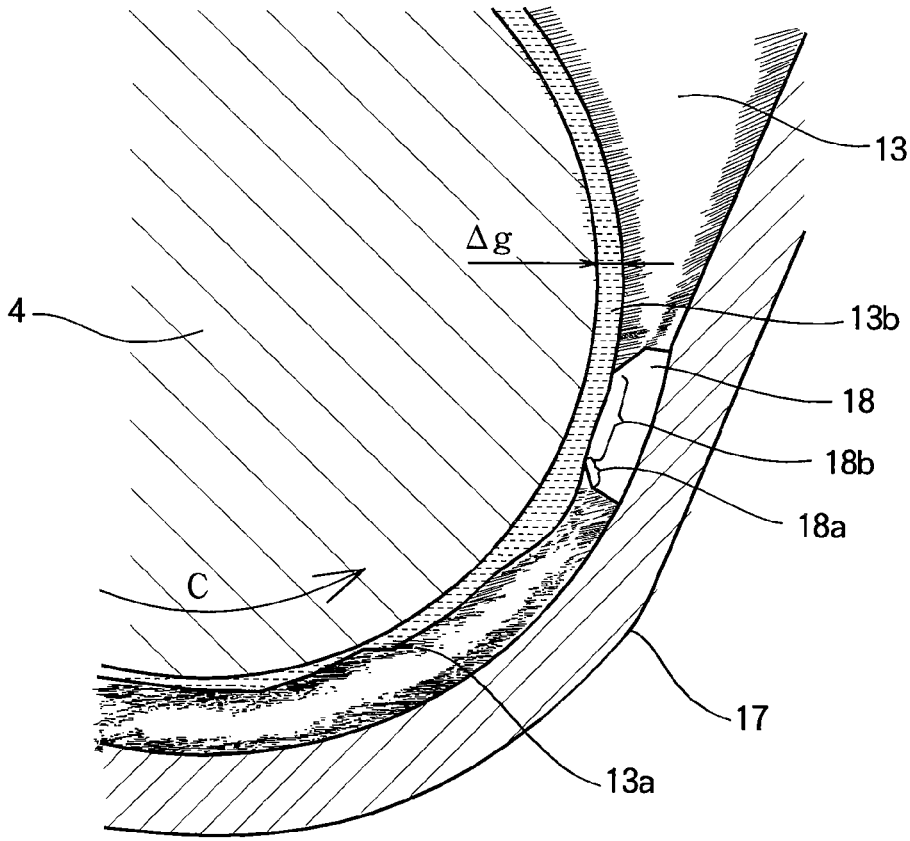
FIG. 8 is an expanded view illustrating the relation between a toner supplying roller and toner of a second embodiment.

FIG. 8 is an expanded view illustrating the relation between a toner supplying roller 4 and toner 13 of the second embodiment. Elements similar to those of the first embodiment have been given the same reference numerals and their description is omitted. The only difference between the first embodiment and the second embodiment is that the rib 18 is a spacer-like piece separate from the toner reservoir 17.

Referring to FIG. 8, the toner 13 in the toner reservoir 17 adheres to the toner supplying roller 4 to form a toner layer 13*a* and a toner layer 13*b*. The toner layer 13*a* is formed upstream of the rib 18 with respect to rotation of the toner supplying roller 4, and the toner layer 13*b* is formed downstream of the rib 18. The rib 18 is formed of a highly rigid material, for example, acrylonitrile-butadiene-styrene copolymer (ABS). The rib 18 is firmly bonded to the inner wall surface of the toner reservoir 17 by means of a highly sticky tape coated on both sides with an adhesive. An adhesive having a high level of adhesion may be used in place of the highly sticky tape. The size of the gap Δg formed between the toner supplying roller 4 and the rib 18 may be selected to be 0.5 mm approximately.

The rib 18 includes a chamfered portion 18*a*. The chamfered portion 18*a* serves as a guide surface similar to the guide surface 170*a* of the first embodiment. The chamfered portion 18*a* guides the toner 13 such that the toner 13 is pressed against the toner supplying roller 4 to form a toner layer having a thickness of Δg.

The rib 18 also includes a surface 18*b* opposing the circumferential surface of the toner supplying roller 4. The surface 18*b* extends in a longitudinal direction along the barrel-shaped toner supplying roller 4 such that the distance between the surface 18*b* and the circumferential surface of the toner supplying roller 4 is uniform across the length of the rib 18. The surface 18*b* serves as a guide similar to the guide surface 170*b*.

Figure 9:
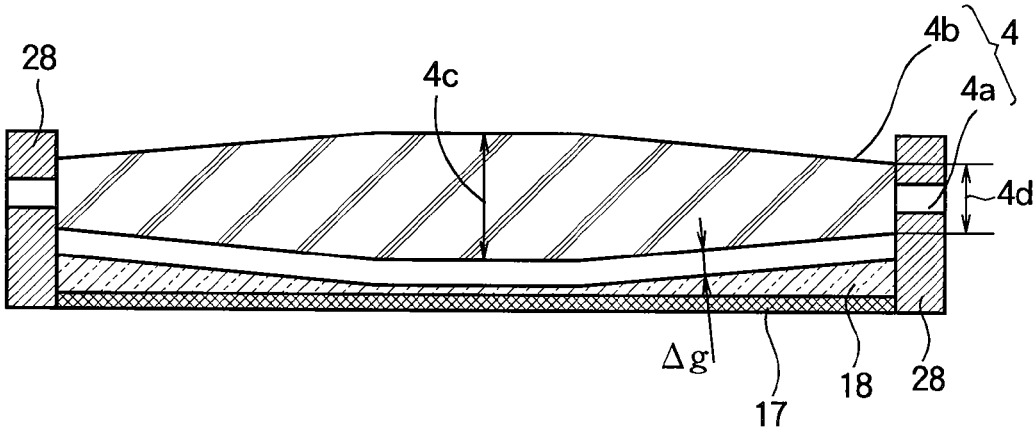
FIG. 9 is a side view illustrating the configuration and arrangement of the rib when the toner supplying roller is in the shape of a barrel.

FIG. 9 is a side view illustrating the configuration and arrangement of the rib 18 relative to the toner supplying roller 4 in the shape of a barrel. The toner supplying roller 4 has a diameter larger nearer a longitudinally middle portion of the toner supplying roller 4. The second embodiment differs from the first embodiment in that the rib 18 is used in place of the rib 170.

The operation of the image forming apparatus and developing apparatus 1 of the second embodiment is substantially the same as that of the first embodiment except that the rib 18 is used in place of the rib 170.

As described above, if the toner reservoir 17 is somewhat deformed or distorted during manufacturing process and therefore the gap Δg needs to be adjusted from apparatus to apparatus, an appropriate size of the rib 18 may be selected from among a plurality of sizes for adjusting the thickness of the toner layer formed on the toner supplying roller 4. Thus, the rib as a single piece of component alleviates dimensional requirements imposed on the toner reservoir 17.

Third Embodiment

The first and second embodiments use the rib 170 in one piece with the toner reservoir 17 or the rib 18 integral with the toner reservoir 17. A third embodiment employs a rod 19 supported such that the rod 19 is not in contact with the inner wall surface of the toner reservoir 17. Description of elements similar to those of the first and second embodiments has been omitted.

Figure 10:
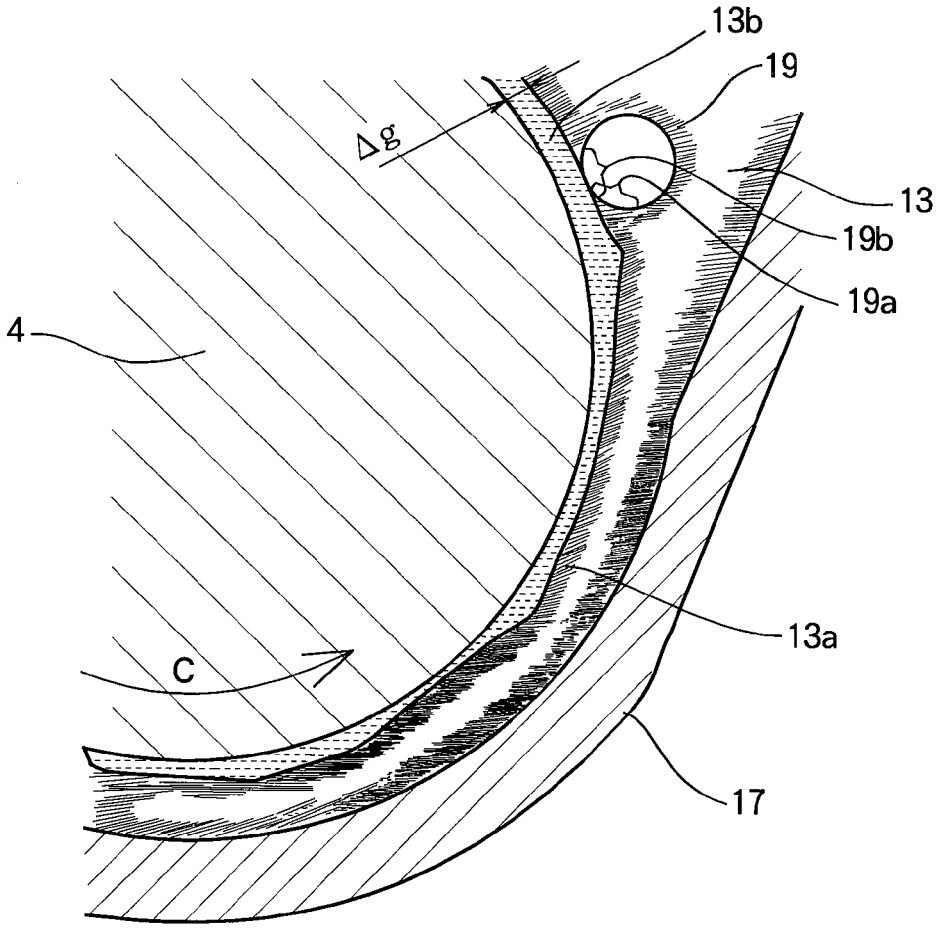
FIG. 10 is an expanded view illustrating the relation between a toner supplying roller and toner of a third embodiment.

FIG. 10 is an expanded view illustrating the relation between a toner supplying roller 4 and toner 13 of the third embodiment. Elements similar to those of the first embodiment (FIGS. 4 and 5) and the second embodiment (FIG. 8) have been given the same reference numerals and their description is omitted.

Figure 11:
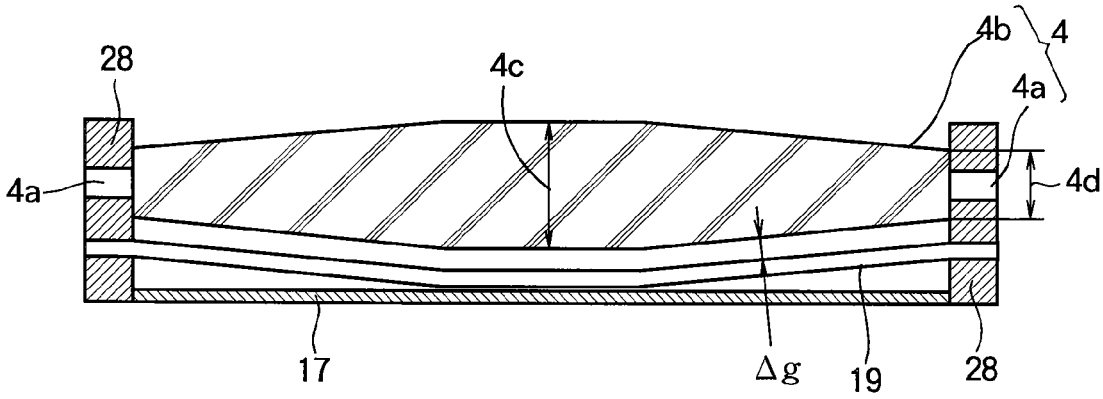
FIG. 11 is a side view illustrating the configuration and arrangement of a rod when a toner supplying roller is in the shape of a barrel.

FIG. 11 is a side view illustrating the configuration and arrangement of the rod 19 in relation to the toner supplying roller 4 in the shape of a barrel. Elements shown in FIG. 11 similar to those shown in FIG. 7 have been given the same reference numerals and their description is omitted.

The rod 19 is not in one piece with the toner reservoir 17 or not contiguous to the toner reservoir 17. The rod 19 is supported by side plates 28 on which the toner supplying roller 4 is supported. The rod 19 is in the shape of a rod having a circular cross section, and is away from the inner wall surface of the toner reservoir 17. The rod 19 is configured to mate with or accommodate the specific contour of the barrel-shaped toner supplying roller 4 such that the gap between the toner supplying roller 4 and the rod 19 is uniform across the full length of the toner supplying roller 4. Thus, the rod 19 describes a curve with a large curvature.

The rod 19 includes a guide surface 19*a* and a guide surface 19*b* (FIG. 10). The guide surface 19*a* functions in a similar manner to the surface 170*a* of the first embodiment. The guide surface 19*b* is closer to the toner supplying roller 4 than the guide surface 19*a*, and extends parallel to the toner supplying roller 4, defining a gap Δg between the toner supplying roller 4 and the rod 19. The guide surface 19*a* guides the toner 13 to enter the gap Δg.

Referring to FIG. 10, the toner 13 adheres to the toner supplying roller 4 to form a toner layer 13*a* and a toner layer 13*b*. The toner layer 13*a* is formed upstream of the rod 19 with respect to rotation of the toner supplying roller 4 and the toner layer 13*b* is formed downstream of the rod 19. The rod 19 does not rotate. The rod 19 is formed of a rigid material (e.g., stainless steel) and is supported on the side plates 28 on which the toner supplying roller 4 is rotatably supported. The gap Δg defined between the toner supplying roller 4 and the rod 19 is approximately 0.5 mm or less. While the rod 19 shown in FIG. 10 has a circular cross section, the rod 19 may have a cross section of any shape (e.g., square, rectangle, or polygon) as long as the gap Δg is 0.5 mm or less.

The operation of the image forming apparatus and developing apparatus 1 of the third embodiment is substantially the same as that of the first embodiment except that the rod 19 is used in place of the rib 170.

As described above, the rod 19 is of a simple shape. It is only necessary to manufacture the side plates 28 such that the center-to-center distance between the rod 19 and the toner supplying roller 4 is accurately set. Thus, it is rather simple to maintain an accurate gap Δg.

Fourth Embodiment

The ribs 170 and 18 and the rod 19 of the previously described embodiments are configured to mate with or accommodate the specific contour of the barrel-shaped toner supplying roller 4 such that the gap between the toner supplying roller 4 and the rib or rod is uniform across the full length of the toner supplying roller 4. In contrast, a toner layer forming member 29 of a fourth embodiment extends straight across the length of a toner supplying roller 4.

Figure 12:
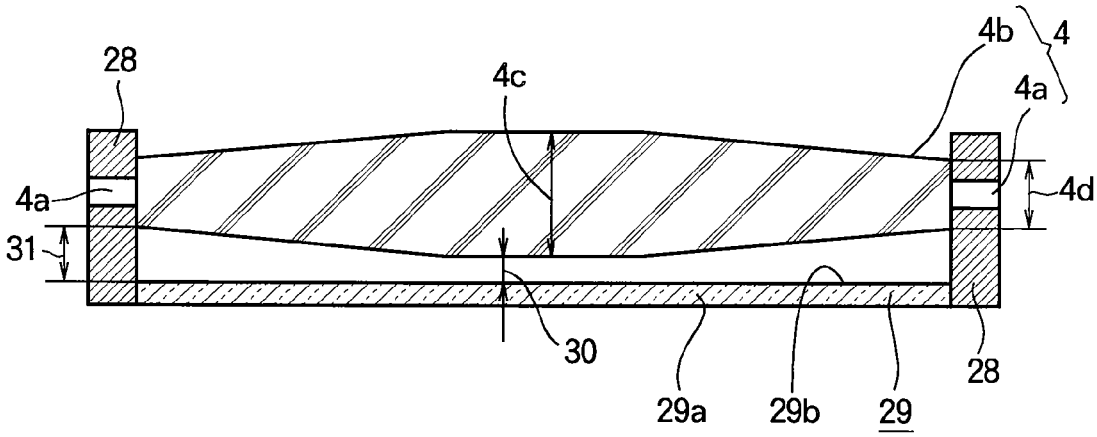
FIG. 12 is a side view illustrating the configuration and arrangement of a toner layer forming member of a fourth embodiment.

FIG. 12 is a side view illustrating the configuration and arrangement of the toner layer forming member 29 in relation to a toner supplying roller 4 in the shape of a barrel. Elements similar to those of the first embodiment (FIG. 7), second embodiment (FIG. 9), or the third embodiment (FIG. 12) have been given the same reference numerals and their description is omitted.

Referring to FIG. 12, the toner layer forming member 29 is equivalent to any one of the rib 170, rib 18, and rod 19 of the previously described embodiments except that the toner layer forming member 29 has a surface that extends straight and is not curved in its longitudinal direction (i.e., does not have a concave surface configured to mate with or accommodate the specific contour of the toner supplying roller 4).

The distance between the toner supplying roller 4 and the toner layer forming member 29 at a longitudinal middle portion 31 and longitudinal end portions is selected to be in the following range.

$$0 \leqq (\text{distance 30 at middle portion}) \leqq 0.5 \text{ mm}$$

$$0 \leqq (\text{distance 31 at end portions}) \leqq 0.5 \text{ mm}$$

The inventor conducted experiments to determine differences in the density of printed images between the longitudinal middle portion and the longitudinal end portions of the toner supplying roller 4.

Table 2 lists occurrence of vague images for various sizes of gaps Δg. Evaluation of vague image was made by printing an image having a print duty of 100%. A difference in density not more than 0.1 implies that vague image cannot be recognized by visual inspection. A difference in density of 0.2 implies that vague image can be recognized by visual inspection. The density of images was measured with the Model X-Rite504 density meter (available from SDG).

The experimental results reveal that if the difference in distance between the longitudinal end portions and the longitudinal middle portion is not more than 0.25 mm, no vague image occurs.

This implies that the difference in distance between the middle portion and end portions not more than 0.25 mm allows stable transport of the toner 13, providing stable print quality.

TABLE 2

| „g at Middle portion (mm) | „g at end portions (mm) | difference in density | Occurrence of Vague image |
|---|---|---|---|
| 0 | 0 | 0 | NO |
| | 0.25 | 0.05 | NO |
| | 0.5 | 0.11 | ≦5% |
| | 0.75 | 0.2 | ≧5% |
| 0.25 | 0 | 0.05 | NO |
| | 0.25 | 0 | NO |
| | 0.5 | 0.05 | NO |
| 0.5 | 0 | 0.11 | ≦5% |
| | 0.25 | 0.05 | NO |
| | 0.5 | 0 | NO |

Based on the experimental results shown in Table 2, the gap Δg is selected to be 0.25 mm at the middle portion and 0.5mm at the end portions.

The toner supplying roller 4 of the fourth embodiment also rotates in the C direction shown in FIGS. 4, 8, and 10. When the toner supplying roller 4 rotates, the toner 13 adheres to the toner supplying roller 4 unevenly. As the toner supplying roller 4 further rotates, the toner 13 enters a gap Δg defined between the toner supplying roller 4 and the toner layer forming member 29, and the toner layer forming member 29 applies pressure on the toner 13 passing through the gap Δg to form a toner layer 13*b* having a predetermined thickness. The difference in the thickness of the toner layer 13*b* between the middle portion of the toner supplying roller 4 and the longitudinal end portions is 0.25 mm.

However, the toner 13 surrounding the toner layer 13*b* neither adheres to the toner layer 13*b* nor exerts any load on the toner layer 13*b*, so that the toner will not detach from the toner layer 13*b*. This ensures stable supply of toner 13 to the developing roller 5.

As described above, the toner layer forming member 29 presses the toner layer 13*a* to form the toner layer 13*b*, ensuring that the toner 13 is reliably deposited to the toner supplying roller 4. Despite the fact that the difference in the thickness of the toner layer 13*b* between the middle portion of the toner supplying roller 4 and the longitudinal end portions is 0.25 mm, the difference in the amount of toner supplied to the toner supplying roller 4 between the middle portion and the longitudinal end portions is small enough to prevent vague images. In other words, a density difference of 0.05 resulting from a difference in gap of 0.25 mm is small enough as long as practical print quality is concerned.

The fourth embodiment eliminates the need for shaping the surface of the toner layer forming member 29 such that a uniform gap Δg is maintained across the full length of the toner supplying roller 4. Thus, the toner layer forming member 29 can be simple in shape and alleviates required dimensional accuracy.

The fourth embodiment makes it possible to form a stable toner layer 13*b* on the toner supplying roller 4, ensuring supply of a stable amount of toner to the developing roller 5. Thus, the fourth embodiment prevents an uneven thickness of the toner layer 13*b*, providing stable print quality.

Fifth Embodiment

The gap Δg between the toner supplying roller 4 and the rib, rod, or toner layer forming member in the aforementioned embodiments is not variable. In contrast, a fifth embodiment uses a variable gap Δg. The description of elements similar to those of the third embodiment is omitted.

Figure 13:
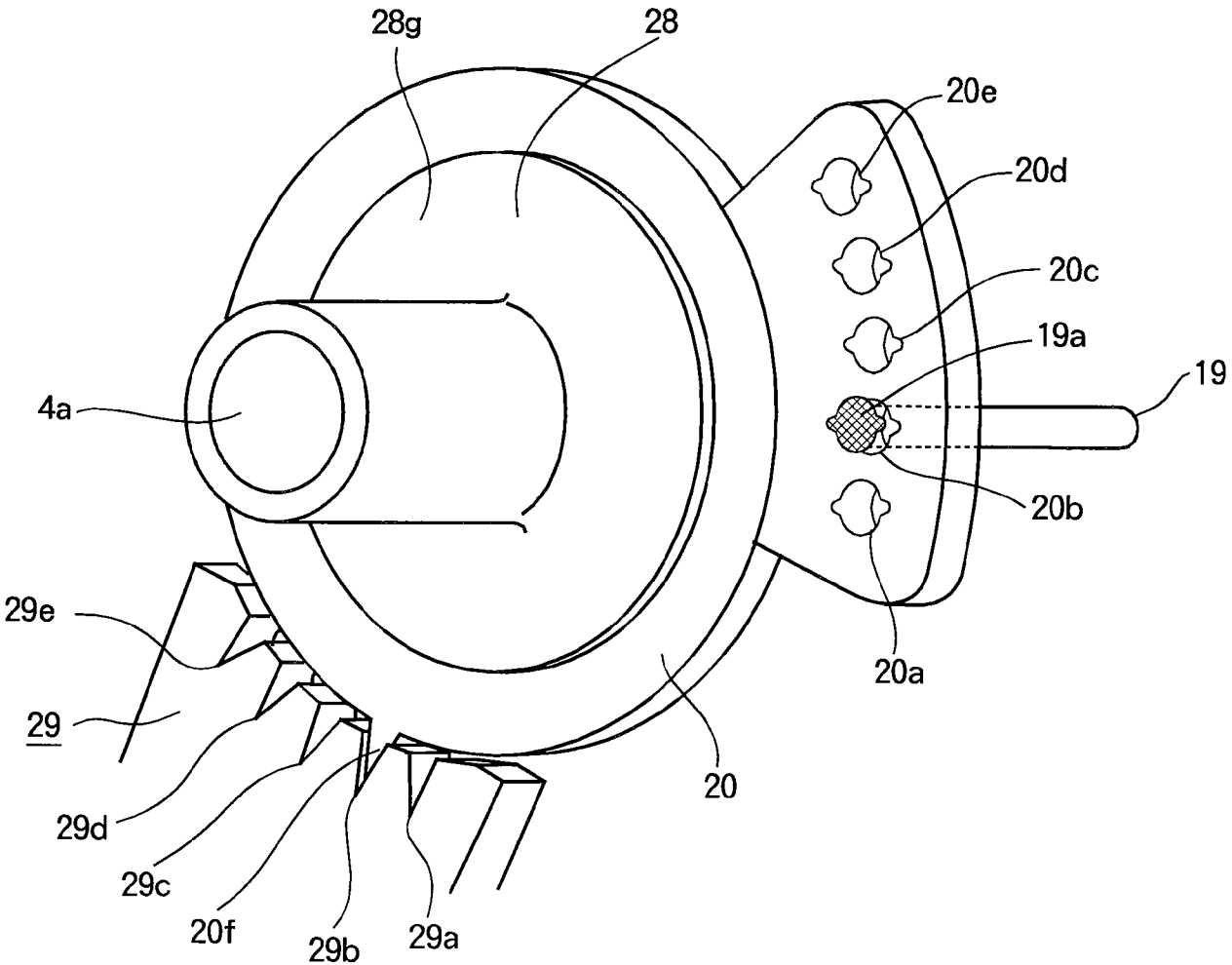
FIG. 13 is a perspective view of a side plate of a fifth embodiment.

FIG. 13 is a perspective view of a side plate 28 of the fifth embodiment.

FIG. 13 illustrates an adjustment mechanism that selects the mounting positions of a rod 19. The rod 19 has a circular cross section, and includes two opposing longitudinal end portions. The rod 19 includes diametrically opposing two radially outwardly projecting projections 19*a* at two opposing end portions of the rod 19. The rod 19 is supported at its longitudinal end portions by two position selectors 20 attached to two opposing side plates 28 such that the rod 19 extends parallel to the toner supplying roller 4. The position selector 20 is retained by a lid (not shown) not to drop off the side plate 28.

The position selector 20 includes a hole 20*a* whose center is a certain distance X mm from the center of a shaft 4*a* of the toner supplying roller 4. Likewise, the centers of holes 20*b*-20*e* are X+0.1 mm, X+0.2 mm, X+0.3 mm, and X+0.4 mm, respectively, from the center of the shaft 4*a*. Thus, the center-to-center distance between the rod 19 and the shaft 4*a* may be adjusted depending on which hole the rod 19 fits. The holes 20*a*-20*e* each have a perimeter substantially in the shape of a circle with two diametrically opposing and outwardly extending portions. The rod 19 is supported with the projection 19*a* fitted into one of the holes 20*a*-20*e*. The fitting engagement of the projection 19*a* into the hole prevents rotation of the rod 19 relative to the side plate 28. Each of the position selectors 20 fits to a mounting seat 28*g* of a corresponding one of the side plates 28. The position selector 20 includes a projection 20f that selectively fits grooves 28*a*-28*e* formed in a rack 29. Selectively fitting the projection 20*f* to the grooves 28*a*-28*e* allows the selector 20 to take up a corresponding position relative to the circumferential surface of the toner supplying roller 4.

Usually, the both longitudinal end portions of the rod 19 are received in the holes of the two opposing selectors 20 in a fitting relation such that the center-to-center distance between the rod 19 and the shaft 4*a* is the same at both longitudinal ends of the rod 19. However, in order to compensate for dimensional errors of the components due to manufacturing errors and wear and tear over time, the rod 19 may be fitted to holes such that the center-to-center distance between the rod 19 and the shaft 4*a* is not the same at two longitudinal ends of the rod 19.

For example, assume that the rod 19 is inserted in the hole 20*b*, and the rod 19 interferes with the toner supplying roller 4 by 0.1 mm. Then, an operator dismounts a lid (not shown) from the side plate 28 to disengage the position selector 20 from the side plate 28. Then, the operator rotates the position selector 20 by an angle about the mounting seat 28*g* to an angular position such that the rod 19 can be inserted into, for example, the hole 20*e*. Then, the projection 20*f* is fitted into the groove 28*e*, thereby preventing the position selector 20 from rotating any further. The gap Δg is now 0.2 mm. The operator then replaces the lid, thereby fixing the position selector 20. It may be determined from inspection of a vague image whether an abnormal condition has occurred in the gap Δg. If an abnormal condition has occurred, the rod 19 can be inserted into another hole for improving print quality.

As described above, the fifth embodiment allows adjustment of the gap Δg by selecting the position of the rod 19 on the position selector 20 so that the gap Δg may be adjusted to absorb dimensional errors of the toner supplying roller 4 and the side plates 28 due to manufacturing variations and deterioration of various components over time. Thus, severe control of manufacturing process and dimensional accuracy of the components may be alleviated, further improving print quality.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A developing apparatus comprising:

an image bearing body on which an electrostatic latent image is formed;

a developing member that supplies a developer material to the electrostatic latent image;

a supplying member that supplies the developer material to said developing member, the supplying member including a cylindrical surface rotatable and in contact with the developing member;

a developer material chamber that holds the developer material therein, the developer material chamber having a first gap formed between the cylindrical surface and a circumferential inner wall surface of the developer material chamber; and a projection that projects from the circumferential inner wall surface of said developer material chamber toward said supplying member, the projection being disposed downstream of the first gap with respect to a rotation of the supplying member, the projection having a first guide surface forming a second gap with the cylindrical surface of the supplying member, the second gap being smaller than the first gap and not more than 0.5 mm.

2. The developing apparatus according to claim 1, wherein said projection is formed in one piece with said developer material chamber.

3. The developing apparatus according to claim 1, wherein said projection is bonded to the circumferential inner wall surface of said developer material chamber.

4. The developing apparatus according to claim 1, wherein said projection is supported by a supporting member that supports said supplying member.

5. The developing apparatus according to claim 1, wherein said supplying member includes a diameter larger nearer a longitudinally middle portion of said supplying member; and wherein said projection extends substantially parallel to said supplying member and the first guide surface extends such that the first guide surface is configured to mate with an outer contour of said supplying member while maintaining the second gap.

6. The developing apparatus according to claim 1, wherein said supplying member includes a diameter larger nearer a longitudinally middle portion of said supplying member; and wherein said projection extends substantially parallel to said supplying member and the first guide surface extends such that the second gap is larger in the vicinity of longitudinal end portions of said supplying member than in a middle portion of said supplying member.

7. The developing apparatus according to claim 1, wherein said supplying member includes a diameter larger nearer a longitudinally middle portion of said supplying member; and wherein said projection is mounted to a mounting member supported on a supporting member that supports said supplying member, the mounting member being movable relative to the supporting member.

8. The developing apparatus according to claim 7, wherein the mounting member is one of two mounting members disposed in the vicinity of longitudinal end portions of said supplying member, each one of said mounting members includes a plurality of fitting engagement portions, wherein the plurality of fitting engagement portions are provided such that center-to-center distances between the plurality of fitting engagement portions and said supplying member are different from one another.

9. The developing apparatus according to claim 1, wherein said developing apparatus is incorporated in an image forming apparatus, the image forming apparatus comprising:

an exposing unit that illuminates a charged surface of said image bearing body to form an electrostatic latent image;

a transfer unit that transfers a visible image from said image bearing body onto a print medium;

a fixing unit that fixes the visible image on the print medium; and a transport unit that transports the print medium.

10. The developing apparatus according to claim 1, wherein said projection is spaced apart from said supplying member by a predetermined gap.

11. A developing apparatus comprising:

an image bearing body on which an electrostatic latent image is formed;

a developing member that supplies a developer material to the electrostatic latent image;

a supplying member that supplies the developer material to said developing member, the supplying member including a cylindrical surface rotatable and in contact with the developing member;

a developer material chamber that holds the developer material therein, the developer material chamber having a first gap formed between the cylindrical surface and a circumferential inner wall surface of the developer material chamber; and a projection that projects from the circumferential inner wall surface of said developer material chamber toward said supplying member, the projection being disposed downstream of the first gap with respect to a rotation of the supplying member, the projection having:

a first guide surface forming a second gap with the cylindrical surface of the supplying member, the second gap being smaller than the first gap, and a second guide surface disposed between the first guide surface and the circumferential inner surface and contiguous with the first guide surface and the circumferential inner wall surface, the second guide surface guides the developer material in the first gap into the second gap as the supplying member rotates.

12. The developing apparatus according to claim 11, wherein said projection is formed in one piece with said developer material chamber.

13. The developing apparatus according to claim 11, wherein said projection is bonded to the circumferential inner wall surface of said developer material chamber.

14. The developing apparatus according to claim 11, wherein said projection is supported by a supporting member that supports said supplying member.

15. The developing apparatus according to claim 11, wherein said supplying member includes a diameter larger nearer a longitudinally middle portion of said supplying member; and wherein said projection extends substantially parallel to said supplying member and the first guide surface extends such that the first guide surface is configured to mate with an outer contour of said supplying member while maintaining the second gap.

16. The developing apparatus according to claim 11, wherein said supplying member includes a diameter larger nearer a longitudinally middle portion of said supplying member; and wherein said projection extends substantially parallel to said supplying member and the first guide surface extends such that the second gap is larger in the vicinity of longitudinal end portions of said supplying member than in a middle portion of said supplying member.

17. The developing apparatus according to claim 11, wherein said supplying member includes a diameter larger nearer a longitudinally middle portion of said supplying member; and wherein said projection is mounted to a mounting member supported on a supporting member that supports said supplying member, the mounting member being movable relative to the supporting member.

18. The developing apparatus according to claim 17, wherein the mounting member is one of two mounting members disposed in the vicinity of longitudinal end portions of said supplying member, each one of said mounting members includes a plurality of fitting engagement portions, wherein the plurality of fitting engagement portions are provided such that center-to-center distances between the plurality of fitting engagement portions and said supplying member are different from one another.

19. The developing apparatus according to claim 11, wherein said developing apparatus is incorporated in an image forming apparatus, the image forming apparatus comprising:

an exposing unit that illuminates a charged surface of said image bearing body to form an electrostatic latent image;

a transfer unit that transfers a visible image from said image bearing body onto a print medium;

a fixing unit that fixes the visible image on the print medium; and a transport unit that transports the print medium.

20. The developing apparatus according to claim 11, wherein said projection is spaced apart from said supplying member by a predetermined gap.

* * * * *